United States Patent [19]

Shomo

[11] Patent Number: 4,660,832

[45] Date of Patent: Apr. 28, 1987

[54] SHOCK AND VIBRATION ABSORBENT HANDLE

[76] Inventor: Robert D. Shomo, 22303 Fairfax, Taylor, Mich. 48180

[21] Appl. No.: 715,975

[22] Filed: Mar. 25, 1985

[51] Int. Cl.[4] ..... A63B 49/08

[52] U.S. Cl. ..... 273/73 J; 273/81 A; 81/22

[58] Field of Search ..... 273/73 J, 75, 72 R, 273/72 A, 81 R, 81 B, 81.4, 67 DA, 73 R, 81 A; 74/551.8, 551.9, 557, 558; 81/177 R, 428 R, 22; 16/110 R; 173/139; 464/180

[56] References Cited

U.S. PATENT DOCUMENTS

| | | | |
|---|---|---|---|
| 1,851,439 | 3/1932 | Mattern | 273/81 R |
| 3,674,267 | 7/1972 | Hollis | 273/73 J |
| 3,941,380 | 3/1976 | Lacoste | 273/73 R X |
| 4,101,125 | 7/1978 | Heath | 273/75 |
| 4,537,399 | 8/1985 | Adam | 273/73 J |

FOREIGN PATENT DOCUMENTS

| | | | |
|---|---|---|---|
| 237831 | 8/1925 | United Kingdom | 273/75 |
| 710625 | 6/1954 | United Kingdom | 273/73 J |

*Primary Examiner*—Richard C. Pinkham
*Assistant Examiner*—Matthew L. Schneider
*Attorney, Agent, or Firm*—Robert G. Mentag

[57] ABSTRACT

A shock and vibration handle for application to the hand gripping portion of the normal handle of an impacted, vibration sensitive item, such as, a tennis racket, a racquetball racket, a golf club, a baseball bat, and other impact devices, such as hammers, and the like. The shock and vibration absorbent handle includes an inner tubular isolation shell of shock and vibration absorbent material mounted on the hand gripping portion of the normal handle. An outer tubular shell is mounted around shock absorbent material, and has it wrapped therearound a covering material. The absorbent material may be employed as longitudinal strips, spaced around the periphery of the handle or an integral, single piece tubular member. The inner tubular shells of absorbent material may be mounted on an inner tubular mounting shell which is mounted on the handle, and which has operatively mounted therein a cantilever spring beam having a weight on the free end thereof. In the last described handle the absorbent material may be deleted since the spring is also a vibration damper.

7 Claims, 20 Drawing Figures

23

24

164

18
19
17
20
20

136
36
37
37
37
50
53
37
35
43
47
12
47
12
45
46
44
43
18b
19b
17b
34
51
10b
16b
23b
56
57
39
38
54
23b
40
37
42
41

17b
18b
19b
20b
20b
34
35
36
37
38
39
40
41
42
43
44
45
46
47
50
51
52
53
54
55
55

SHOCK AND VIBRATION ABSORBENT HANDLE

BACKGROUND OF THE INVENTION

1. Technical Field

The field of art to which this invention pertains may be generally located in the class of devices employing handles that are subject to shock and vibration, as for example, tennis rackets, racquetball rackets, golf clubs, baseball bats, and various other impact devices such as hammers, and the like.

2. Background Information

It is known in the medical art that shock and vibration generated by striking a tennis ball with a tennis racket, a baseball with a baseball bat, and so forth, affect muscle tissue and arm joints, such as elbow joints. "Tennis elbow" is a painful affliction which affects muscle tissue and elbow joints of active tennis players. Most medical theories attribute "tennis elbow" to continuous exposure of the playing arm of a tennis player to shock and vibration generated by striking a tennis ball with a tennis racket. The energy generated is usually high frequency, short duration with rapid decay, and which otherwise is known as "impact shock". The problem solved with the present invention is the reduction or elimination of shock and vibration to the muscle tissue and arm joints of the users of tennis rackets, racquetball rackets, golf clubs, baseball bats and other impact devices such as hammers, and the like.

SUMMARY OF THE INVENTION

In accordance with the present invention, a shock and vibration absorbent handle is provided for use on various products such as tennis rackets, racquetball rackets, golf clubs, baseball bats, and various other impact devices such as hammers, and the like. Tests of a shock and vibration absorbent handle, with partial damping, made in accordance with the present invention show, that when it was used on a tennis racket, there was an approximate 71 percent reduction in the vibrations transmitted to the tennis rackets users hand and arm, and that the most discernible frequency of vibration was lowered from 2200 Hz to 1200 Hz. The shock and vibration reduction was shown to be proportional to both the volume of the vibration absorbent material used in the handle, that is, the thickness, length and width, and to the vibration absorbent properties of any such material used. The shock and vibration absorbent handle of the present invention can effectively be used with similar results on other impacted, vibration sensitive items such as golf clubs, racquetball rackets, baseball bats, hammers, and the like. Torsional vibration absorption and reduction of the same, was also observed, and quite evident during the aforementioned tests on a tennis racket.

DESCRIPTION OF THE PREFERRED EMBODIMENTS

Figure 1:
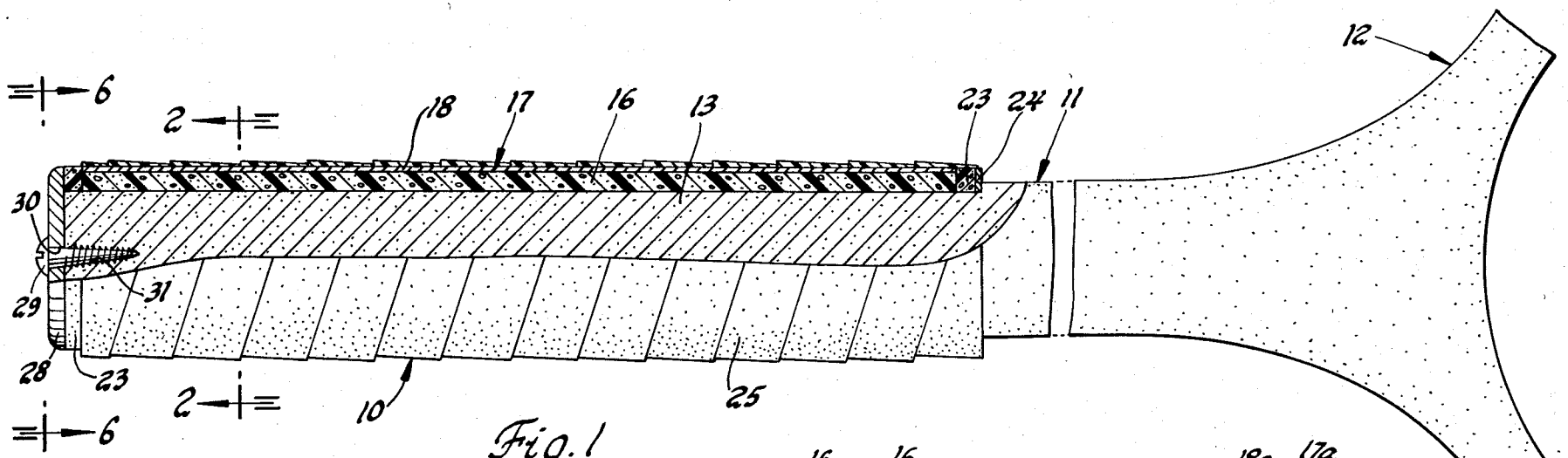
FIG. 1 is broken, plan view of a handle of a tennis racket provided with a shock and vibration absorbent handle, with partial damping, and shown partly in section, with parts broken away, and made in accordance with the principles of the present invention.

Referring now to the drawings, and in particular to FIG. 1, the numeral 10 generally designates a shock and vibration absorbent handle which comprises a first embodiment made in accordance with the principles of the present invention. The numeral 11 generally designates the usual handle of a conventional tennis racket, generally indicated by the numeral 12. The usual handle 11 of a conventional tennis racket may be made from wood, metal or a composite material. The numeral 13 shows a modified part of the usual handle 11 wherein the handle rear end portion, for a length of about six and seven-eighths inches has been reduced to a reasonable and suitable size as for example, a one and one-quartter inch diameter, a one inch diameter, a seven-eighths of an inch diameter, and so forth.

Figure 2:
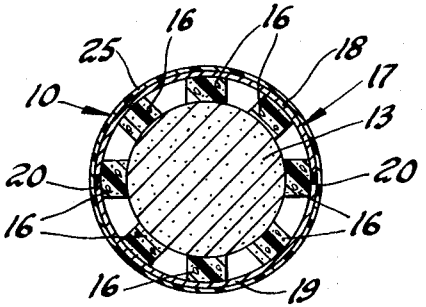
FIG. 2 is a cross section view of the handle structure shown in FIG. 1, taken along the line 2—2 thereof, and looking in the direction of the arrows.

As shown in FIG. 2, the shock and vibration absorbent handle 10 is provided with partial damping, including a tubular inner isolation shell, such as a cylindrical tubular shell, of shock absorber material, which comprises a plurality of longitudinally disposed strips 16 of said material. As shown in FIG. 2, there are eight absorbent material strips which, are disposed about the periphery of the reduced diameter modified tennis racket handle portion 13 and adhered thereto by a suitable adhesive. The absorbent material strips 16 are about one-quarter inch in width and at least about one-sixteenth of an inch in thickness. The absorbent material strips 16 are evenly spaced about the periphery of the modified handle portion 13. The numeral 17 in FIGS. 1, 2 and 10 generally designates a tubular outer shell, such as a cylindrical tubular shell, made from any suitable lightweight material, such as aluminum, plastic and the like. The outer shell 17 comprises two semi-tubular parts 18 and 19 which have the outer longitudinal ends 20 spaced apart from each other, as shown in FIG. 2, when the outer shell 17 is mounted around the outer periphery of the inner isolation shell formed by the absorbent material strips 16 and adhered thereto by a suitable adhesive.

As shown in FIG. 1, a pair of washers 23, made from the same energy absorbent material as the strips 16, are positioned at the opposite ends of the outer shell strips 16. The absorbent material washers 23 are about one-eighth of an inch thick, but their outer periphery extends beyond the outer periphery of the outer shell strips 16, and they abut the opposite ends of the outer tubular shell 17. The inner diameter of the absorbent material washers 23, in the embodiment shown in FIG. 1, is about one inch and the outer diameter is about three-sixteenth of an inch. A suitable metal retainer washer 24, made from any suitable material as, for example, cold rolled steel, is positioned between the shoulder formed where the reduced diameter handle portion 13 and the regular handle portion 11 meet, and the inner absorbent material washer 23. A conventional or standard tennis racket handle covering material, such as leather, vinyl, plastic or other suitable material, is indicated by the numeral 25, and it is illustrated as being wrapped around the outer periphery of the outer shell 17 in a conventional manner, and it extends over the inner end absorbent material washer 23 and the retainer washer 24, but it does not extend over the outer end absorbent material washer 23. The outer end absorbent material washer 23 is releasably secured on the modified handle portion 13 by an end cap 28, which is made from any suitable material as, for example, aluminum. The end cap 28 is secured to the outer end of the modified handle portion 13 by a suitable wood screw 29, which passes through an axial hole 30 formed through the end cap 28 and into threaded engagement with a threaded hole 31 formed in the outer end of the modified handle portion 13. The outer diameter of the end cap 28 is made to a dimension equal to the outer diameter of the absorbent material washers 23. The end cap 28 is made to a thickness of about one-eighth of an inch.

A test of the shock and vibration absorbent handle 10 as applied to a test tennis racket 12 showed that there was an approximate seventy-one percent reduction in the vibrations transmitted to the tennis racket user's hand and arm. A number of tennis rackets were reviewed for the test. A "typical" racket was selected for testing, and it comprised a Bancroft Bjorn Borg model of wood construction. The shock absorbent material employed for the absorbent material strips in the handle 10, shown in FIG. 1, comprised a vibration absorbent material which is a number 4701 cellular urethane, and available on the market under the trademark "PORON". The engineering specifications concerning the 4701 cellular urethane are readily available in the marketplace. Other suitable vibration absorbent materials may also be used for making the shock absorbent strips 16 for the partial damping handle 10.

In making the test, it was assumed that since all structures vibrate at their own natural frequency when impacted, a tennis racket on striking a tennis ball also vibrates at its own natural frequency, and this frequency is transmitted to the player's hand, wrist and arm muscles and bones. It was also assumed for test purposes that the vibration damping effect of holding a vibrating tennis racket versus clamping a vibrating tennis racket is minimal. A further engineering assumption in making the test is that either impacting or not impacting the center of percussion of a tennis racket (sweet spot) has little or no effect on the natural frequency of the racket. Only the severity of the frequency is affected. In carrying out the aforementioned tests, the test tennis racket was horizontally clamped at the lower handle portion 10 to a rigid structure. Care was taken to closely simulate the clamping-force of a human hand. A piezoelectric accelerometer was mounted on the handle of the racket at a point 3.25 inches from the outer end thereof. The accelerometer employed was an Endvco Model 2220C. A Tektronix Model 564 storage oscilloscope, with type 3A3 dual trace differential amplifier and type 3B3 time base was employed.

Figure 19:
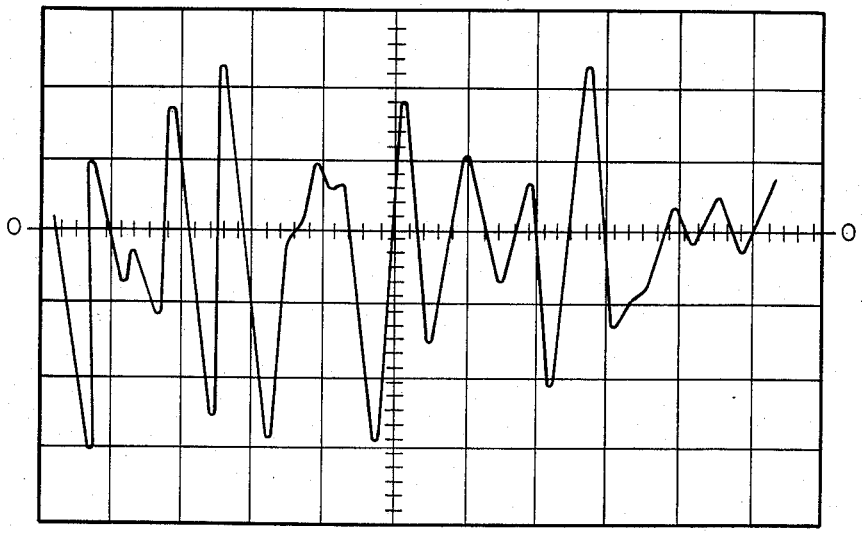
FIG. 19 is a "typical" oscilloscope trace generated by an accelerometer mounted on the handle of a test tennis racket, prior to the installation of a shock and vibration absorbent handle with, partial damping, made in accordance with the principles of the present invention.
Figure 20:
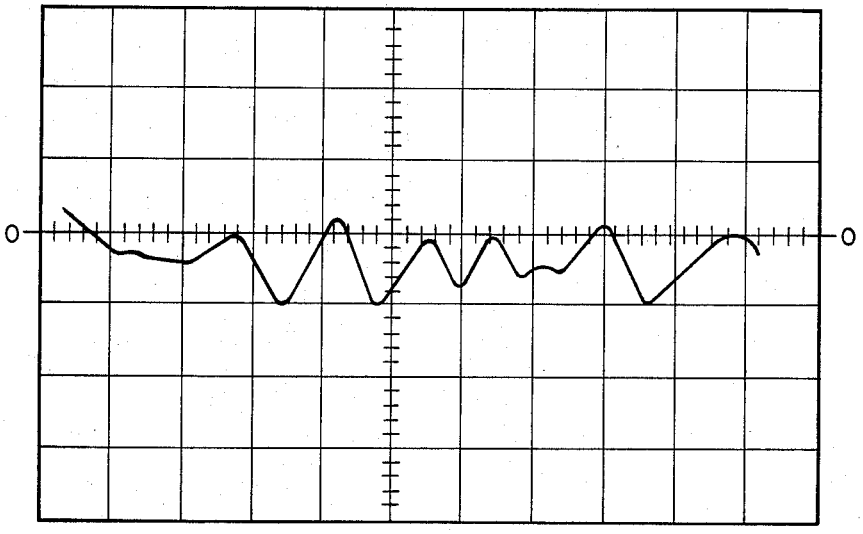
FIG. 20 is a "typical" oscilloscope trace generated after the installation of a shock and vibration absorbent handle, with partial damping, on the test tennis racket used in the production of the oscilloscope trace of FIG. 19.

An impact force on the test tennis racket was generated by dropping a 56.2 gram tennis ball from a height of 43.25 inches onto the center of percussion of the horizontally mounted tennis racket. Photographs were taken of the resultant oscilloscope traces generated from the accelerometer. These oscilloscope traces were analyzed to determine frequency and energy absorption data. A summary of the results of the test is shown in FIGS. 19 and 20. FIG. 19 illustrates a "typical" oscilloscope trace generated by the accelerometer, mounted on the handle of the test tennis racket 12, prior to installing the "shock and absorbent handle" 10. FIG. 20 is a "typical" oscilloscope trace after installing the "shock and vibration absorbent handle" 10. Both series of tests, before and after mounting the handle 10, on the same tennis racket, were conducted under identical conditions and using identical dial settings on the storage oscilloscope.

Tests results without a "shock and vibration absorbent handle" installed were as follows:

(a) average vibration intensity (peak amplitudes, measured in mm) averaged 36.2 mm.

(b) the predominant natural frequency of the unmodified tennis racket was approximately 2200 Hz with other frequencies superimposed.

Test results with a "shock and vibration absorbent handle installed were as follows:

(a) average vibration intensity (peak amplitudes, measured in mm) average 10.5 mm.

(b) the predominant natural frequency of the modified tennis racket was approximately 1200 Hz with no discernible frequencies superimposed.

The shock and absorbent reduction effected by the handles of the present invention is proportionate to both the volume (thickness, length, width) of the vibration absorbent material employed, and to the vibration absorbent properties of any such material used. The aforedescribed tests on a tennis racket show that the shock and vibration absorbent handle of the present invention can effectively be used with similar results on other impacted, vibration sensitive items such as golf clubs, racquetballs rackets, baseball bats, hammers, etc. Torsional vibration absorption and reduction, using the shock and vibration absorbent handle 10 during the test, was observed and such reduction was quite evident during the test with the test tennis racket.

Figure 3:
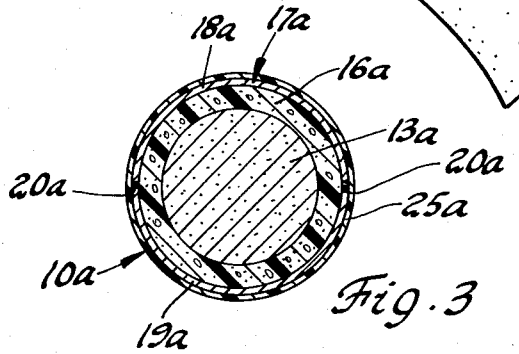
FIG. 3 is a cross section view, similar to FIG. 1, of a second embodiment of a shock and vibration absorbent handle made in accordance with the principles of the present invention.
Figure 5:
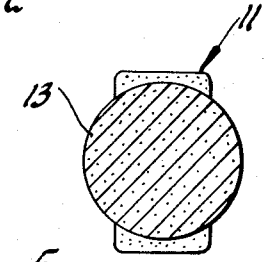
FIG. 5 is a cross section view of the tennis racket handle shown in FIG. 4, taken along the line 5—5 thereof, and looking in the direction of the arrows.
Figure 6:
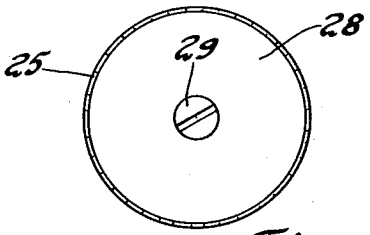
FIG. 6 is a left end view of the tennis racket handle shown in FIG. 1, taken along the line 6—6 thereof, and looking in the direction of the arrows.
Figure 4:
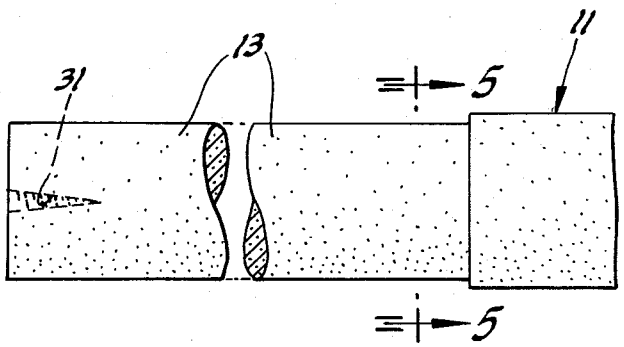
FIG. 4 is a broken, plan view of the handle of the tennis racket handle shown in FIG. 1, before the shock and vibration absorbent isolation material is applied to the handle.

FIG. 3 is a cross section view of a second embodiment shock and vibration absorbent handle made in accordance with the principles of the present invention. The parts of the handle shown in FIG. 3 which are the same as the parts of the handle shown in the first embodiment of FIGS. 1 and 2 have been marked with the same reference numerals followed by the small letter "a". The only difference between the second embodiment of FIG. 3 and the first embodiment of FIGS. 1 and 2 is that the inner isolation shell of shock absorbent material 16 is employed in the second embodiment of FIG. 3 as a one-piece tubular member 16*a*, shown more particularly in FIG. 8. The inner shell 16*a* in the second embodiment of FIG. 3 is illustrated as a cylindrical member, and is made to the same length as the strips 16 which comprise the inner absorbent material shell in the first embodiment of FIGS. 1 and 2. The thickness of the tubular inner shell 16*a* is also made to the same size as the thickness of the strips 16 in the first embodiment of FIGS. 1 and 2. The tubular inner shell 16*a* is adhered to the handle 13*a* by a suitable adhesive. The outer shell 17*a* is adhered to the inner shell 16*a* by a suitable adhesive.

The embodiment of FIG. 3 provides full damping. The illustrated tubular shell of absorber material 16*a* was made to a length of six and one-half inches long. The tubular vibration absorbent inner shell 16*a* may be made from any suitable vibration absorbent material as, for example, the same material from which the strips 16 are made. That is, an elastomeric foam cushioning 4701 cellular urethane, available on the market under the trademark "PORON".

FIGS. 11 through 18 illustrate a third embodiment of the invention, and the parts thereof which are the same as the first embodiment of FIGS. 1 and 3 have been marked with the same reference numerals followed by the small letter "b".

Figures 7, 8, 9, 10, 11, 12:
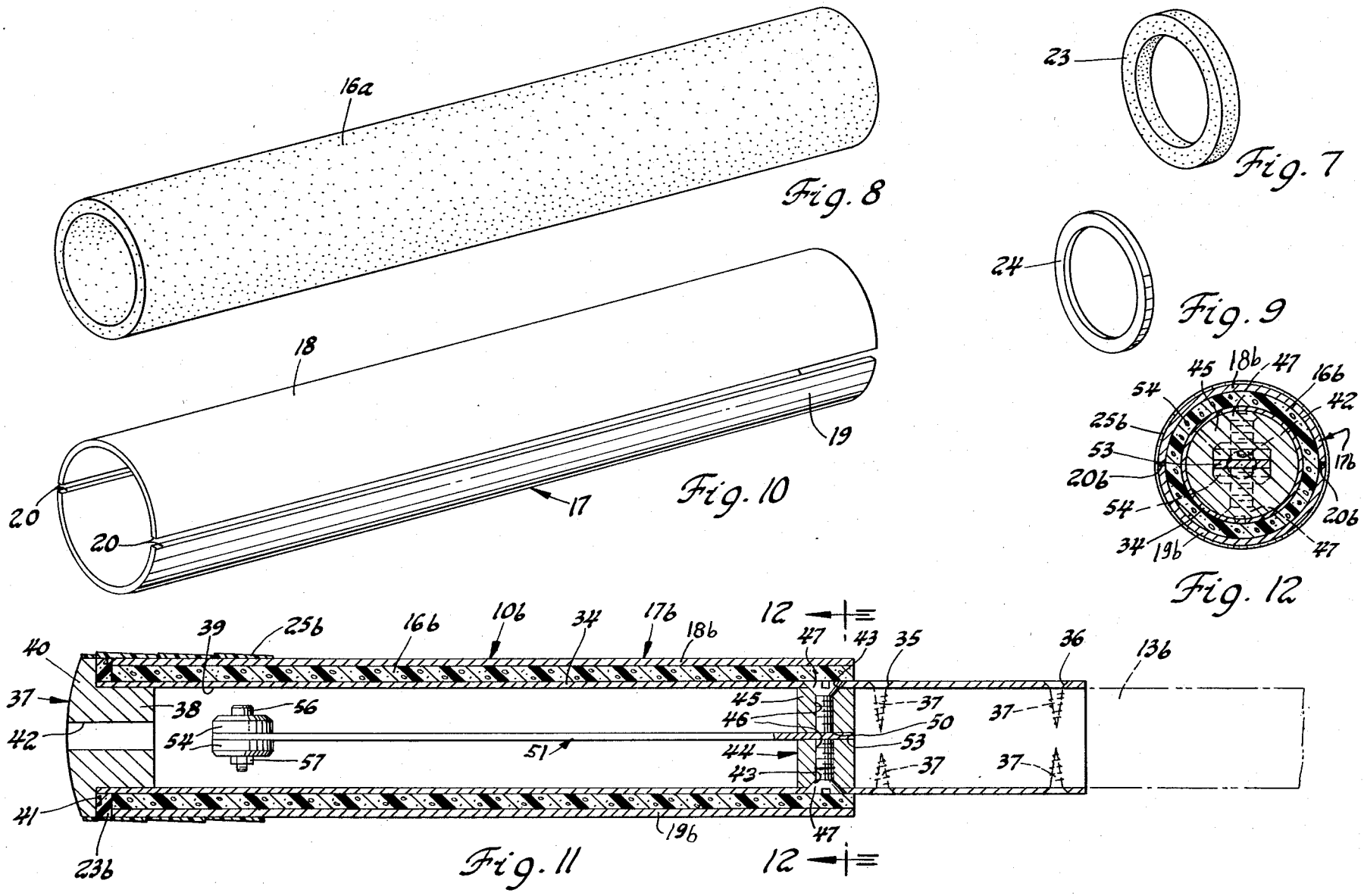
FIG. 7 is a perspective view of an energy absorber washer employed in the shock and vibration absorbent handle illustrated in FIG. 1.
FIG. 8 is a perspective view of a energy absorber inner isolation tubular shell employed in the shock and vibration absorbent handles illustrated in FIGS. 3 and 11.
FIG. 9 is a retainer washer employed in the shock and vibration absorbent handle illustrated in FIG. 1.
FIG. 10 is a split tubular outer shell for the shock and vibration absorbent handle illustrated in FIG. 1.
FIG. 11 is a longitudinal section view of a third embodiment of the invention made in accordance with the principles of the present invention.
FIG. 12 is an elevation section view of the third embodiment of FIG. 11, taken along the line 12—12 thereof, and looking in the direction of the arrows.

The shock and vibration absorbent handle 10*b* includes an inner tubular isolation shell 16*b* made from a suitable vibration absorbent material. As shown in FIG. 12, the tubular inner shell 16*b* is illustrated as a cylinder, as shown in FIG. 8, to provide full damping. It will be understood that the tubular inner shell 16*b* could also be made as a partial damping shell as in the embodiment of FIG. 2. An outer tubular shell 17*b*, made in two parts, 18*b* and 19*b*, is mounted around the outer periphery of the inner tubular isolation shell 16*b* to provide an outer support shell. A conventional handle covering 25*b* is also wrapped around the outer aluminum shell 17*b*.

As shown in FIGS. 11 and 12, the handle 10*b* includes a tubular inner mounting shell 34, which is illustrated as a one-piece cylindrical aluminum tubing, having a one inch outer diameter and a 0.049 inches wall thickness. The inner mounting shell 34 is about eight and one-half inches long. As shown in FIG. 11, the inner end of the inner mounting shell 34 slidably receives the reduced round end 13*b* of a tennis racket handle, and it is secured thereto by suitable wood screws 37 that pass through the holes 36 and 35, formed through the inner end of the inner mounting shell 34, and into threaded engagement with holes in the reduced diameter racket handle portion 13*b*. It will be understood that a length of the regular handle of the tennis racket would have to be cut off, equivalent to the length of the handle portion 10*b*. The inner metal shell 34 is enclosed at its outer end by a handle cap, generally indicated by the numeral 37. The end cap 37 has an outer cylindrical portion 40, and an integral reduced diameter inner end portion 38 that forms a shoulder 41 where these two portions meet. As shown in FIG. 11, when the end cap 37 is mounted in the outer end of the inner mounting shell 34, the shoulder 41 seats against the outer end of the inner mounting shell 34 and against the outer face of the outer energy absorption washer 23*b*. An axial hole 42 is formed through the end cap 37, and communicates with the interior 39 of the inner mounting shell 34. A damper spring beam 51 is longitudinally disposed in the interior 39 of the inner mounting shell 34. The inner end 53 of the damper spring beam 51 is slidably mounted in a rectangular slot 50 (FIG. 17) that is axially formed through a cylindrical holder member 45. The beam holder member 45 is slidably mounted in the inner mounting shell 34, in a position in alignment with the inner end of the outer shell 17*b* and the tubular isolation shell 16*b*.

The damper spring beam 51 is releasably secured in the holder member 44 by a suitable pair of machine screws 47, which are mounted through a pair of oppositely disposed holes 43, formed through the inner mounting shell 34, and into threaded engagement with a pair of aligned threaded holes 46 in the holder member 44. As shown in FIG. 11, the inner ends of the screws 47 engage the inner end 53 of the beam 51 to hold it in operative position within the interior 39 of the inner mounting shell 34.

Figures 13, 14, 15, 16, 17, 18:
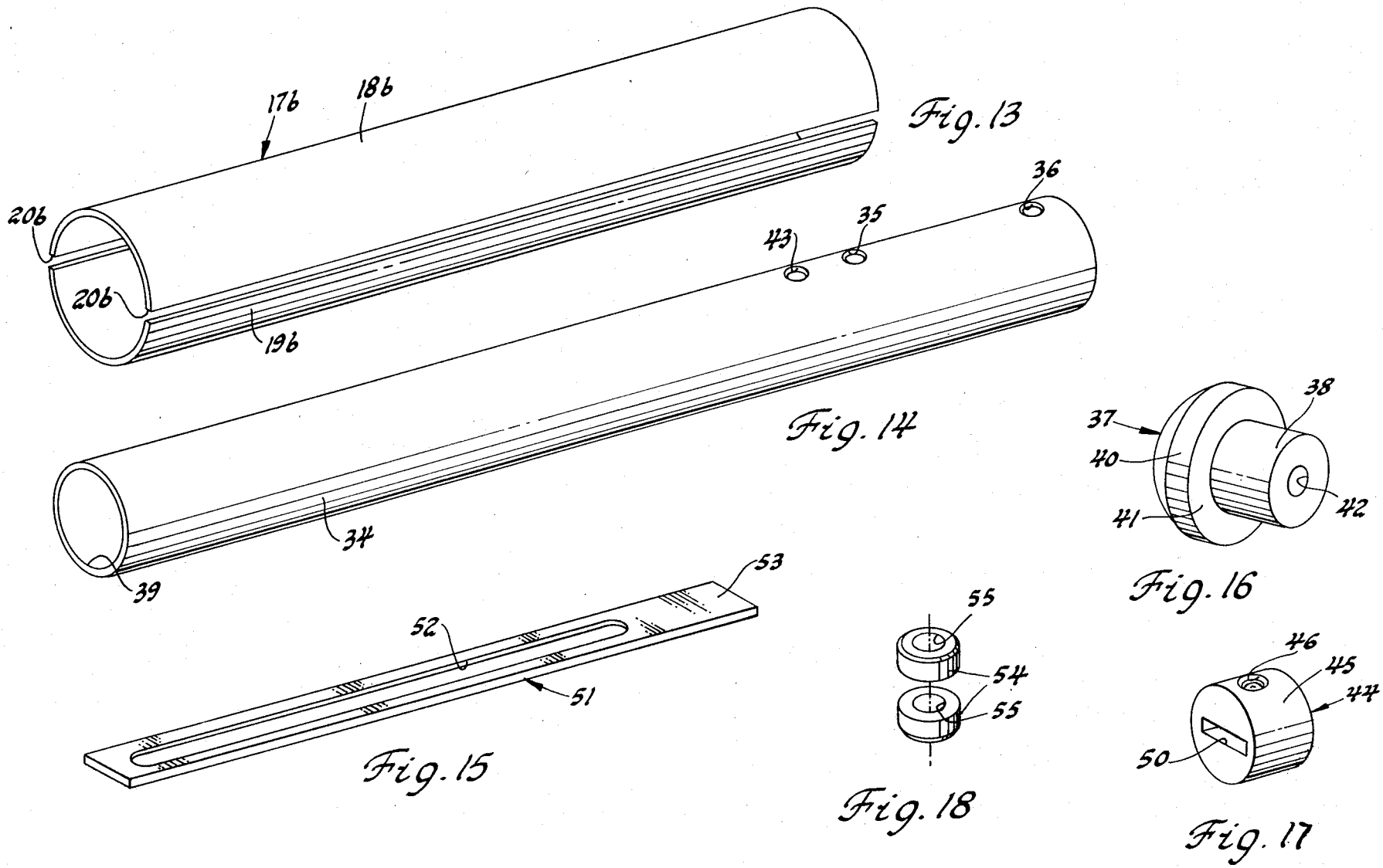
FIG. 13 is a perspective view of an elongated, split outer tubular shell or tubing employed in the third embodiment of FIG. 11.
FIG. 14 is a perspective view of an elongated, one-piece inner tubular mounting shell employed in the third embodiment of FIG. 11.
FIG. 15 is a perspective view of a damper spring beam employed in the third embodiment of FIG. 11.
FIG. 16 is a perspective view of a handle end cap employed in the third embodiment of FIG. 11.
FIG. 17 is a damper spring beam holder employed in the third embodiment of FIG. 11.
FIG. 18 is a perspective view of two damper weights employed in the third embodiment of FIG. 11.

A pair of weights 54 are slidably mounted on opposite sides of the outer end of the damper spring beam 51, and secured in place by a screw 56 and nut 57. The screw 56 is adapted to be slidably mounted through an elongated slot 52 which is formed through the beam 51, as shown in FIG. 15. The metal screw 56 passes through axial bores 55 formed through the weights 54, as shown in FIG. 18.

The weights 54 and the length of the beam 51 are designed so that the weights 54 vibrate at a frequency which is the same as the natural frequency of a tennis racket, therefore absorbing and dissipating the vibrational energy generated.

The outer shells 17, 17*a* and 17*b* employed in the three embodiments of the invention are all made in two parts so as to provide a split tubular member. The outer shell is preferably split in this manner into two parts so that the vibration on one side of the handle will not be transmitted to the other side of the handle. The outer shells 17, 17*a* and 17*b*, and the inner mounting shell 34 may be made from any suitable lightweight material, such as aluminum, a plastic material, and the like. The cross section shape of the three embodiments of the invention and the mating parts thereof may be of any conventional or desired shape.

The following formula illustrates a method of determining the size of the weight 54 for a certain size beam 51.

$$W = \frac{b^3 h E (2.43)}{L^3 f_n^2}$$

In the above listed formula, "W" equals the weight in pounds to be determined for the weight 54. "b" equals the width of the beam 51, "h" equals the heighth of the beam 51, and "L" equals the length of the beam 51. "E" equals Young's modulus of material for a rectangular steel beam. The numeral 2.43 is a constant. The symbol $f_n^2$ is the natural frequency of the impact vibration sensitive item, which is to be provided with a shock and vibration handle made in accordance with the principles of the present invention.

For a selective beam 51 which is 0.5 inches wide, 0.06 inches high, and 5 inches long, with a natural frequency of 1100 Hertz, the weight size of the weight 54, when determined by the aforementioned formula, and converted to grams, is 0.21 grams. The rectangular slot in the beam would be accounted for by subtracting the width of the slot from the beam width of 0.5 inches when employing the aforementioned formula for determining the weight. The natural frequency of the selected impact vibration sensitive item, as for example a tennis racket, is determined by suspending the item on a suitable string or rope, mounting a conventional accelerometer on the item, and then giving the item a hit or whack. The item will shake momentarily and the frequency of the vibration will be observable on the accelerometer.

What is claimed is:

1. A shock and vibration handle for application to the hand gripping portion of a normal handle on an impacted, vibration sensitive item, characterized in that it comprises:

(a) a tubular inner isolation shell of shock and vibration absorbent material adapted to be mounted on the hand gripping portion of a normal handle;

(b) a tubular outer rigid shell having an outer periphery and being mounted around said tubular inner isolation shell of shock and vibration absorbent material and comprising two elongated equal shell portions which do not touch each other;

(c) means for holding said tubular inner and outer shells in mating position on the hand gripping portion of a normal handle; and, (d) a handle covering material operatively mounted around the outer periphery of said tubular outer shell.

2. A shock and vibration handle for application to the hand gripping portion of a normal handle on an impacted, vibration sensitive item, as defined in claim 1, characterized in that:

(a) said tubular inner isolation shell of shock and vibration absorbent material comprises a plurality of strips of said material, evenly spaced longitudinally about the hand gripping portion of the normal handle.

3. A shock and vibration handle for application to the hand gripping portion of a normal handle on an impacted, vibration sensitive item, as defined in claim 1, characterized in that:

(a) said tubular inner isolation shell of shock and vibration material comprises a one-piece tubular shell of such absorbent material.

4. A shock and vibration handle for application to the hand gripping portion of a normal handle on an impacted, vibration sensitive item, as defined in either one of claims 2 or 3, characterized in that:

(a) the tubular inner isolation shell of shock and vibration absorbent material is circular in cross section configuration and adapted to be mounted on a reduced diameter hand gripping portion of a normal handle, and the tubular outer shell is circular in cross section.

5. A shock and vibration handle for application to the hand gripping portion of a normal handle on an impacted, vibration sensitive item, as defined in either one of claims 2 or 3, characterized in that:

(a) the tubular inner isolation shell of shock and vibration absorbent material is non-circular in cross section configuration and adapted to be mounted on a reduced diameter hand gripping portion of a normal handle, and the tubular outer shell is non-circular in cross section.

6. A shock and vibration handle for application to the hand gripping portion of a normal handle on an impacted, vibration sensitive item, characterized in that it comprises:

(a) a tubular inner isolation shell of shock and vibration absorbent material adapted to be mounted on the hand gripping portion of a normal handle;

(b) a tubular outer shell having an outer periphery and being mounted around said tubular inner isolation shell of shock and vibration absorbent material and comprising two elongated equal shell portions which do not touch each other;

(c) means for holding said tubular inner and outer shells in mating position on the hand gripping portion of a normal handle;

(d) a handle covering material operatively mounted around the outer periphery of said tubular outer shell;

(e) said tubular inner isolation shell of shock and vibration absorbent material comprising a plurality of strips of said material, evenly spaced longitudinally about the hand gripping portion of a normal handle;

(f) said tubular inner isolation shell of shock and vibration absorbent material being adapted to be mounted on the handle gripping portion of a normal handle by a tubular inner mounting shell which has one end fixedly mounted on the hand gripping portion of the normal handle; and, (g) an elongated damping spring beam disposed in said tubular inner mounting shell, said beam having one end attached to the end of the tubular inner mounting shell that is adapted to be fixed to a normal handle, and the other end of said beam carrying a weight which is free to vibrate within the tubular inner mounting shell when the item is impacted.

7. A shock and vibration handle for application to the hand gripping portion of a normal handle on an impacted, vibration sensitive item, characterized in that it comprises:

(a) a tubular inner isolation shell of shock and vibration absorbent material adapted to be mounted on the hand gripping portion of a normal handle;

(b) a tubular outer shell having an outer periphery and being mounted around said tubular inner isolation shell of shock and vibration absorbent material and comprising two elongated equal shell portions which do not touch each other;

(c) means for holding said tubular inner and outer shells in mating position on the hand gripping portion of a normal handle;

(d) a handle covering material operatively mounted around the outer periphery of said tubular outer shell;

(e) said tubular inner isolation shell of shock and vibration material comprising a one-piece tubular shell of such absorbent material;

(f) said tubular inner isolation shell of shock and vibration absorbent material being adapted to be mounted on the hand gripping portion of a normal handle by a tubular inner mounting shell which has one end fixedly mounted on the hand gripping portion of the normal handle; and, (g) an elongated damping spring beam disposed in said tubular inner mounting shell, said beam having one end attached to the end of the tubular inner mounting shell that is adapted to be fixed to a normal handle, and the other end of said beam carrying a weight which is free to vibrate within the tubular inner mounting shell when the item is impacted.

* * * * *